United States Patent [19]

Enoksson et al.

[11] 4,089,702

[45] May 16, 1978

[54] METHOD OF CLEANING INTERNAL SURFACES EMPLOYING AN EXPLOSIVE GAS

[75] Inventors: Bertil Petrus Enoksson, Gyttorp; Lars Uno Lennart Eriksson, Nora, both of Sweden

[73] Assignee: Nitro Nobel AB, Gyttorp, Sweden

[21] Appl. No.: 763,223

[22] Filed: Jan. 27, 1977

[30] Foreign Application Priority Data

Dec. 20, 1974 Sweden ..... 7416110

[51] Int. Cl.[2] ..... B08B 9/00

[52] U.S. Cl. ..... 134/1; 102/23; 134/17; 134/22 R

[58] Field of Search ..... 134/1, 5, 17, 22 R, 134/22 C, 21; 102/23; 137/15; 164/132

[56] References Cited

U.S. PATENT DOCUMENTS

| | | | |
|---|---|---|---|
| 144,843 | 11/1873 | Goldsmith et al. | 134/17 X |
| 1,388,854 | 8/1921 | Dezendorf | 134/17 UX |
| 2,752,272 | 6/1956 | Fay | 134/17 |
| 3,009,837 | 11/1961 | Lipp et al. | 134/17 |
| 3,743,692 | 7/1973 | Vinton et al. | 134/17 X |

FOREIGN PATENT DOCUMENTS

| | | | |
|---|---|---|---|
| 126,585 | 1/1960 | U.S.S.R. | 134/17 |

*Primary Examiner*—Richard V. Fisher
*Assistant Examiner*—Marc L. Caroff
*Attorney, Agent, or Firm*—Hane, Roberts, Spiecens & Cohen

[57] ABSTRACT

Particles adhering to the internal surfaces of an object are removed by conveying an explosive gas or gas mixture to the chamber defined by the surfaces, and detonating the gas or mixture. The detonation loosens the adhering particles, which are then removed from the chamber. The invention has particular application to the removal of particles from the internal surfaces of a body having a plurality of outlets communicating with the chamber.

5 Claims, No Drawings

METHOD OF CLEANING INTERNAL SURFACES EMPLOYING AN EXPLOSIVE GAS

This application is a continuation of application Ser. No. 640,551 filed Dec. 15, 1975 and now abandoned.

BACKGROUND OF THE INVENTION

The present invention relates to a method of loosening particles, such as sand and scale, from internal surfaces of objects, particularly of metal. The invention has special application for castings, which after having been cast must be cleaned from various particles adhering to the surfaces which have been laid bare. External surfaces do not pose any major problems during the cleaning, and this is also the case as regards internal surfaces which are easily accessible from the outside. However, there are certain internal surfaces which are difficult or impossible to reach with tools from the outside. Blowing through with compressed air has not proved to be effective. Nor, has the use of a gas explosion outside the object, the hot combustion gases then being conveyed through the object, been sufficiently successful.

SUMMARY OF THE INVENTION

An object of the present invention is to make it possible to clean internal surfaces, even surfaces which are difficult to reach. According to the invention, this is achieved by a gas or a gas mixture, which can be caused to detonate, being conveyed into the spaces formed by the surfaces which are to be cleaned. When the detonation proceeds through the gas, heavy turbulence and whirls of high temperature and high pressure are obtained, whereby adhering solid particles are removed from the surfaces. Particularly, flow instabilities behind the shock waves in the exothermic system then seem to be the decisive factor. The explosive gas can be at atmospheric pressure, or an overpressure or a partial vacuum.

DETAILED DESCRIPTION OF THE INVENTION

According to the invention, the outlet openings of the object can be closed after the cavities have been filled with explosive gas. The initiation can take place directly in the cavity by means of an electric spark, an electrically heated filament, or an ignition charge, or the detonation can be conducted into the object via a plastic hose or a tube. The hose or tube should appropriately contain an explosive gas or have its inner walls coated with a composition that reacts to a shock wave and can maintain this. It is particularly convenient to fill the cavities of the object by conducting explosive gas into them through the ignition hose. An appropriate gas mixture is oxyhydrogen gas consisting of 2 parts by volume hydrogen gas and 1 part by volume oxygen. Other ratios are possible, and the detonation velocity and the energy content can thereby be regulated. The oxygen can also be fed with air, the explosive mixture then being diluted with nitrogen. A lower pressure is obtained, which can be an advantage in cases where the object would be damaged by a higher pressure. A number of other gas mixtures can be used. Mixtures of gaseous hydrocarbons and oxygen, such as 1 part by volume of actylene and 2.5 parts by volume of oxygen are particularly sutiable. Further variants of gas mixtures are those formed by a fuel from a volatile fluid, for instance acetone, and oxygen or air. The fluid should then appropriately be inserted in a liquid form, and allowed to evaporate inside the cavity. A certain contribution towards the loosening of the solid particles is then obtained in that the fluid penetrates in behind the particles, due to a low surface tension. This effect is also obtained with the explosive gas mixture, particularly if a vacuum is arranged in the cavity before the explosive gas mixture is conveyed into it.

Hydrogen and oxygen give mixtures which can detonate within a very wide range, from 15 percent by volume hydrogen up to 90 percent at atmospheric pressure. The stoichiometric mixture gives a detonation velocity of approx. 2800 m/sec. and a detonation temperature of 3600 K. The pressure is increased from 1 atmosphere to 19 atmospheres. If the oxygen is added in the form of air, the detonation velocity of the stoichiometric mixture is reduced to 1900 m/sec. and the temperature to 2900 K. The detonation pressure is somewhat more than 3 atmospheres lower.

The most essential feature of this procedure is that the most intensive mechanical stresses are obtained just where they are desired, at the particles. There are gas pockets there which will detonate somewhat later than when the shock reaches the particles. Intersections arise there between supersonic flows and flows which have a lower velocity. The turbulence is particularly intensive at rough surfaces, i.e. at the particles. The material is also subjected to vibrations which contribute towards the loosening of the particles. The overpressure in the cavity breaks the closures at the openings. The hot gas flows out, and carries along some of the particles. However, this gas flow is of minor significance for the actual loosening of the contaminations on the surfaces but, on the other hand, great importance is attached to the pressure relief.

An advantage of the invention is that the process can be repeated an arbitrary number of times. It can be advisable to start with a gas mixture that gives a low pressure, possibly working with a vacuum, in order to reduce the stresses on the walls of objects that could otherwise be damaged, thereafter successively increasing the effect until the result desired has been obtained. It can also be efficient to combine the effect of a fluid with a low surface tension with an explosive mixture of permanent gases.

The present invention will be described in the following together with an application thereof, viz. a cleaning of a valve housing made of cast metal, with internal walls that are not easily accessible.

All of the outlets of the valve housing, except for one, were sealed with tape. Through the remaining opening, a gas mixture consisting of 3 parts by volume hydrogen gas and 1 part by volume oxygen was conveyed into the valve housing. Thereafter, this opening was closed with a plug containing an electric igniter. By means of a capacitor-type ignition device the igniter was caused to emit a spark, which initiated the enclosed gas and caused it to detonate. After the detonation, it was established that particles had loosened and to a certain extent had gone out together with the gas that was ejected, and more particles could be shaken out of the valve housing. The valve housing was sealed again, as described above, and was filled with gas anew, which was caused to detonate. More particles were loosened. The valve housing was then cleaned, and a third detonation did not release any further particles.

It is not necessary to close the openings, as previously mentioned. The valve housing can be placed in the open air or in a plastic bag. The essential point is that the explosive gas mixture fills up the cavity in the object. When using an overpressure or a vacuum, it is necessary to work with a closed system.

The best results have been obtained when all openings in the object have been sealed with tape, in such a way that the seals have been broken by the detonation. The use of fixed closures such as rubber stoppers, or an entirely open system, has not proved to be as efficient. It is obvious that the sudden relief substantially contributes towards the loosening of contaminations from the walls.

We claim:

1. A method of loosening and removing particles from internal surfaces of an object to clean said surfaces, which object has a plurality of outlets leading to a chamber defined by said internal surfaces, said method comprising: closing off all but one of said outlets of said object with means for sealing off said all but one of said outlets and for unsealing said all but one of said outlets in response to pressure emanating from said chamber defined by said internal surfaces; conveying an explosive gas to said chamber via said one outlet which is not closed off; detonating said explosive gas so that said gas penetrates into the chamber and thereby loosens said particles, said step of detonating said explosive gas comprising creating a pressure within said chamber sufficient to break said means for sealing off said all but one of said outlets to thereby unseal said all but one of said outlets, whereby said thus exploded explosive gas is allowed to exhaust via said all but one of said outlets and carry with it loosened particles so that internal surfaces are cleaned.

2. The method according to claim 1, wherein said step of detonating said explosive gas comprises detonating said explosive gas before said explosive gas enters said chamber.

3. The method according to claim 1, wherein said step of detonating said explosive gas comprises detonating said explosive gas when said explosive gas has already been conveyed to said chamber.

4. The method according to claim 1, wherein said step of conveying said explosive gas to said chamber comprises creating a vacuum in said chamber.

5. The method according to claim 4, further comprising reducing pressure in said chamber after said particles are removed and again conveying an explosive gas to said chamber via said but one of said outlets, and again detonating said explosive gas.

* * * * *